United States Patent [19]

Malaval

[11] Patent Number: 4,552,210

[45] Date of Patent: Nov. 12, 1985

[54] DEVICE FOR PRODUCING STEAM BY HEAT EXCHANGE BETWEEN A HEAT-TRANSFER LIQUID METAL AND FEED WATER

[75] Inventor: Claude Malaval, Antony, France

[73] Assignee: Novatome, Le Plessis Robinson, France

[21] Appl. No.: 437,642

[22] Filed: Oct. 29, 1982

[30] Foreign Application Priority Data

Dec. 18, 1981 [FR] France ..... 81 23667

[51] Int. Cl.[4] ..... F28F 19/00

[52] U.S. Cl. ..... 165/134.1; 122/32; 165/161; 376/399; 376/402

[58] Field of Search ..... 165/134 R, 159, 160, 165/161; 376/402 X, 290, 377, 389, 399 X; 122/32, 34, 512

[56] References Cited

U.S. PATENT DOCUMENTS

| | | | |
|---|---|---|---|
| 3,768,554 | 10/1973 | Stahl | 165/159 X |
| 3,811,498 | 5/1974 | Ferraro et al. | 165/161 |
| 3,930,537 | 1/1976 | Wolowodiuk | 165/160 X |
| 4,043,867 | 8/1977 | Benqué et al. | 376/399 X |
| 4,127,389 | 11/1978 | Hackemesser et al. | 165/159 X |
| 4,163,470 | 8/1979 | Johnsen et al. | 122/32 X |
| 4,293,383 | 10/1981 | Lakra et al. | 376/290 |
| 4,307,685 | 12/1981 | Robin et al. | 165/134 R X |
| 4,309,252 | 1/1982 | Gilroy | 376/290 |
| 4,418,748 | 6/1983 | Pouderoux et al. | 165/161 X |

*Primary Examiner*—Sheldon J. Richter
*Assistant Examiner*—Randolph A. Smith
*Attorney, Agent, or Firm*—Pollock, Vande Sande & Priddy

[57] ABSTRACT

Device for producing steam by heat exchange between a heat-transfer liquid metal and feed water, comprising a cylindrical casing (31) receiving liquid metal in its upper part through at least one nozzle (35, 36). The liquid metal enters in a space bounded by a central sleeve (38), a lower perforated distribution plate (40) and a first perforated plate (45). A second perforated plate (46) parallel to the latter is separated therefrom by perforated crosspieces (47). The perforated plates (45 and 46) are disposed between the sleeve (38) and a peripheral sleeve (39). The three plates (40, 45 and 46) have identical perforations which are aligned in the vertical direction. The distribution plate (40) is provided with stiffening ribs (44) ensuring the distribution of the liquid metal thereon. The invention applies, in particular, to fast breeder nuclear reactor steam generators cooled by liquid sodium.

3 Claims, 2 Drawing Figures

DEVICE FOR PRODUCING STEAM BY HEAT EXCHANGE BETWEEN A HEAT-TRANSFER LIQUID METAL AND FEED WATER

FIELD OF THE INVENTION

The invention relates to a device for producing steam by heat exchange between a heat-transfer liquid metal and feed water.

BACKGROUND OF THE INVENTION

A device of this type, for example a steam generator for a fast breeder nuclear reactor cooled by liquid sodium, comprises an elongate cylindrical casing disposed with its axis vertical, closed top and bottom with convex ends.

In such a steam generator, liquid sodium is fed to the upper part of the casing by nozzles traversing this casing and emerging in a space which is bounded by a central sleeve which is coaxial with the steam generator casing and by an annular perforated plate connected to the casing and to the central sleeve and disposed at the lower part of the latter. The central sleeve extends a certain distance above and below the liquid metal entry nozzles, the annular plate fastened to the lower part of this central sleeve thus being below the nozzles and constituting the lower part of the liquid sodium overflow.

Within the space into which the nozzles emerge, and which constitutes the liquid sodium overflow, deflectors are arranged which enable the liquid sodium to be distributed over the whole of the annular plate.

In the case where the liquid sodium is fed by two diametrically opposed nozzles, these deflectors constitute two assemblies each arranged opposite a nozzle and each providing the distribution of the liquid sodium over an annular half-plate.

These deflectors comprise horizontal plates arranged opposite each of the nozzles and occupying the major part of the space which exists between the central sleeve and the casing.

Above the nozzles the casing is lined with a sleeve coaxial with the casing and of slightly less diameter than the casing, for thermal protection of the upper part of the latter.

The liquid sodium fills the whole of the casing up to a level located above the nozzles, i.e., in the zone of the casing which is protected by the peripheral sleeve which includes openings allowing the passage of a certain quantity of sodium between the casing and the peripheral sleeve.

The space inside the casing from the level of liquid sodium to the upper end of the casing contains an inert gas such as argon.

The zone into which the nozzles emerge and which acts as the liquid sodium overflow is separated from the part of the casing situated above the nozzles by a solid annular plate fastened to the casing and to the central sleeve.

The part of the casing situated below the liquid sodium overflow encloses a nest of tubes wound around a body arranged axially inside the steam generator casing. The liquid sodium circulates in contact with the exterior surface of the tubes of the nest inside which the feed water flows that evaporates as a result of heat exchange with the circulating liquid sodium.

At the base of the nest, the liquid sodium passes into the central hollow body, which is perforated with holes, to be evacuated to the lower part of the steam generator casing. Collectors disposed at the input and output of the nest of tubes allow for the distribution of feed water and the recovery of the steam produced by heat exchange inside the nest.

A device of this type, comprising a perforated distribution plate and an assembly of horizontal plate deflectors, makes it possible both to ensure as uniform as possible a circulation of liquid sodium towards the base and to suppress turbulence in the upper level of sodium. In fact, it is necessary to avoid such turbulence in the upper level of the liquid sodium, which is liable to create thermal shocks and to induce the generation of gas.

Moreover, in the event of a leak from an element of the nest of tubes leading to a reaction between the liquid sodium and the water circulating in the nest, the pressure wave resulting from this very energetic reaction must be able to move freely towards the top of the casing of the steam generator to expand itself at the free surface of the liquid sodium.

In prior art devices, the pressure wave passes along the chimney constituted by the central sleeve whose upper limit is a little below the level of the liquid sodium, but in reality this chimney does not present an adequate passage for the pressure wave.

The pressure wave therefore propagates in the liquid sodium overflow situated at the periphery of the central chimney, is reflected by the deflecting plates disposed in this overflow, and propagates through the liquid sodium entry nozzles towards the primary sodium/-secondary sodium exchangers, disposed in the nuclear reactor, which ensure the heating of the secondary sodium that constitutes the liquid metal in the steam generator, by the primary sodium, filling the nuclear reactor tank, and constituting the primary fluid. These sodium/sodium intermediate exchangers may therefore be damaged by the pressure wave.

SUMMARY OF THE INVENTION

The object of the invention is therefore to propose a device for producing steam by heat exchange between a heat-transfer liquid metal and feed water, comprising an elongate cylindrical casing disposed with its axis vertical, closed top and bottom by a solid end, receiving liquid metal in its upper part through at least one nozzle traversing the casing and emerging in a space bounded by a central sleeve coaxial with the casing and extending a certain distance above and below the liquid metal entry nozzle and by a lower perforated annular plate situated between the casing and the central sleeve, and at the lower part of this sleeve, in such a way that the level of liquid metal is maintained above the liquid metal entry nozzle, inert gas filling the space existing between the level of liquid metal and the upper end of the casing, and that a circulation of liquid metal is established in the casing, in contact with a nest of tubes in which circulates the feed water which is being vaporized, the said nest of tubes being situated below the space where the liquid metal enters, the liquid metal leaving the casing at its lower part, a peripheral sleeve of diameter similar to that of the casing being fastened on the casing and arranged coaxially at a short distance from it in its part located above the liquid metal entry nozzle, this device for producing steam making it possible to obtain a turbulence-free upper level of liquid metal and to obtain an easier path for the shock wave towards the top of the steam generator as far as the level of liquid metal without this shock wave being sent laterally towards the intermediate exchangers.

With this aim, two parallel perforated annular plates are fastened between the central sleeve and the peripheral sleeve, above the liquid metal entry nozzle, spaced according to the height of the casing and separated by vertical perforated crosspieces, the perforations of the annular plates and of the lower plate being identical in size and disposition on the plates and aligned in the vertical direction.

BRIEF DESCRIPTION OF THE DRAWINGS

In order that the invention may be more clearly understood, a steam generator according to the prior art, and a steam generator including the improvements according to the invention, in the case where the vaporization is obtained by heat exchange between secondary liquid sodium coming from the intermediate exchangers of a fast breeder nuclear reactor and feed water introduced into the steam generator nest of tubes, will now be described by way of example with reference to the annexed figures.

DETAILED DESCRIPTION

Figure 1:
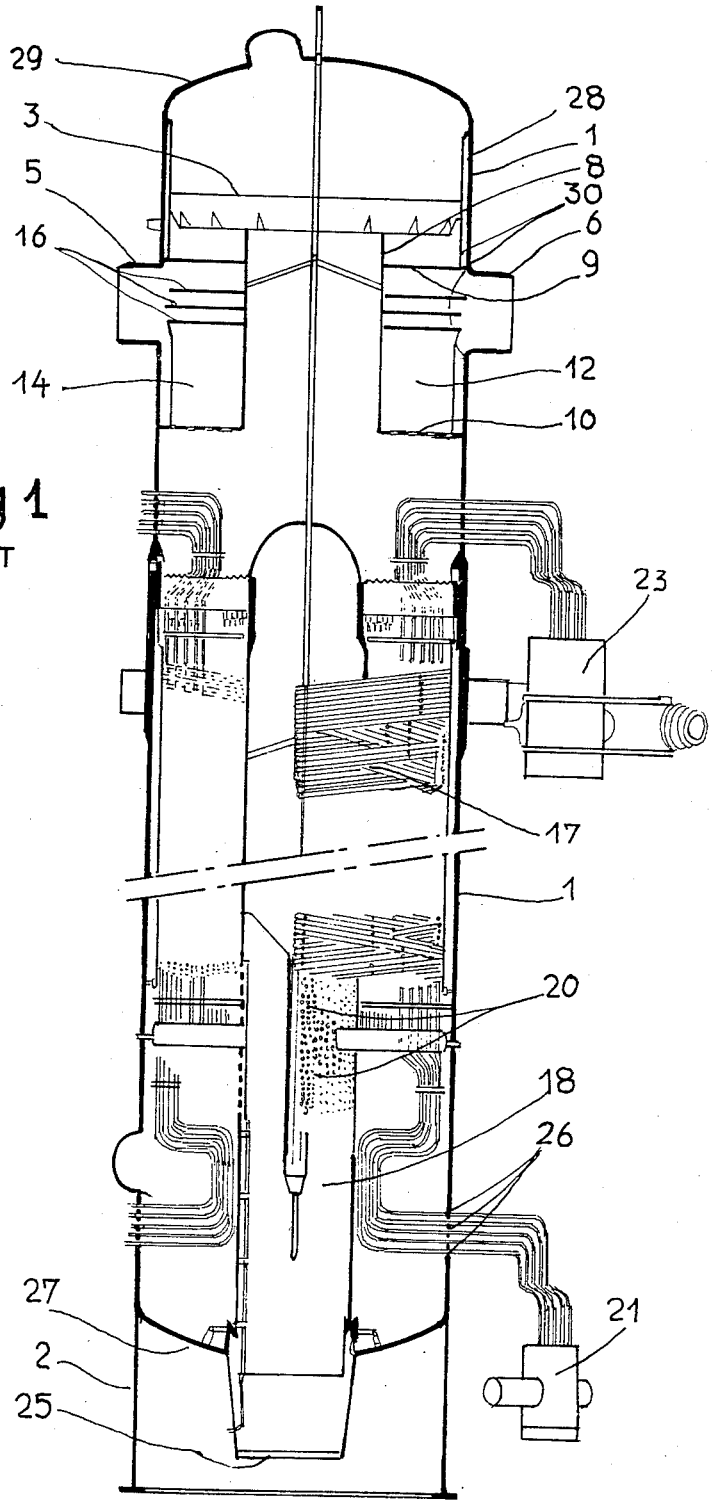
Fig 1 PRIOR ART
FIG. 1 shows a steam generator according to the prior art in a sectional view through a vertical plane.

FIG. 1 shows the casing 1 of a very long cylindrically shaped steam generator disposed vertically and resting on a supporting base 2.

This casing 1 is constantly filled with liquid sodium up to the level 3 of the upper part of the casing. This liquid sodium coming from intermediate exchangers of a fast breeder nuclear reactor is introduced into the casing by means of the nozzles 5 and 6.

The secondary sodium is heated, prior to its introduction into the steam generator, by primary sodium in the intermediate exchangers of the fast breeder nuclear reactor which is cooled by the primary sodium.

At the output of the nozzles 5 and 6, the heat-transfer secondary sodium penetrates into a zone comprising an overflow bounded on the one hand by the casing 1 and on the other hand by a central sleeve 8 arranged coaxially with respect to the casing 1. The central sleeve 8 is connected to the casing by means of a solid annular plate 9 and a perforated annular plate 10 constituting respectively the upper partition wall and the distribution plate of the liquid sodium overflow.

The deflectors 12 composed of vertical partitions 14 and horizontal deflecting plates 16 are placed within this liquid sodium distribution zone.

The devices 12 make a homogeneous sodium distribution possible in the whole of the steam generation section which is below the plate 10 and in which the nest of tubes 17 is situated.

The horizontal plates 16 also serve to prevent turbulence in the level of sodium 3.

The whole of this assembly of plates, central sleeve, and deflectors is completely immersed in the sodium.

The nest of tubes 17 is wrapped around a hollow central body 18 perforated with an assembly of holes 20 for the recovery of the liquid sodium which has circulated in contact with the nest of tubes and been cooled by producing the vaporization of the water circulating inside the tubes of the nest.

One of the ends of the nest is connected to a distributor 21 which enables the water to be distributed among the tubes of the nest. The other end of the nest is connected to a collector 23 allowing the recovery of the steam produced.

The sodium leaves the casing 1 at its lower end by a nozzle 25 disposed in the extension of the hollow body 18.

The hot sodium introduced into the casing by the nozzles 5 and 6 is distributed onto the plate 10 and from there homogeneously through the whole section of the nest. The hot sodium enters into contact with the tubes of the nest and produces vaporization of the feed water flowing in the tubes and becomes cooled during its fall in contact with the nest.

The part of the casing disposed around the base of the hollow body 18 inside which the entry sections of the tubes of the nest pass contains sodium at a relatively low temperature for the protection of these tube portions and of those arrangements for leaktight entry 26 into the casing 1.

A certain amount of the cold sodium situated in this annular part of the casing, however is evacuated by the nozzle 25 owing to openings 27 provided in the inside of the casing at the entry of this nozzle. In this way, deposits of impurities carried by the sodium are avoided.

A thermal protection sleeve 28 is disposed coaxially with respect to the casing above the nozzles 5 and 6 and welded to this casing near the upper end 29. Some sodium penetrates into the annular space between the sleeve 28 and casing 1 by the perforations 30. In this way, thermal protection of the upper part of the casing 1 is provided.

Figure 2:
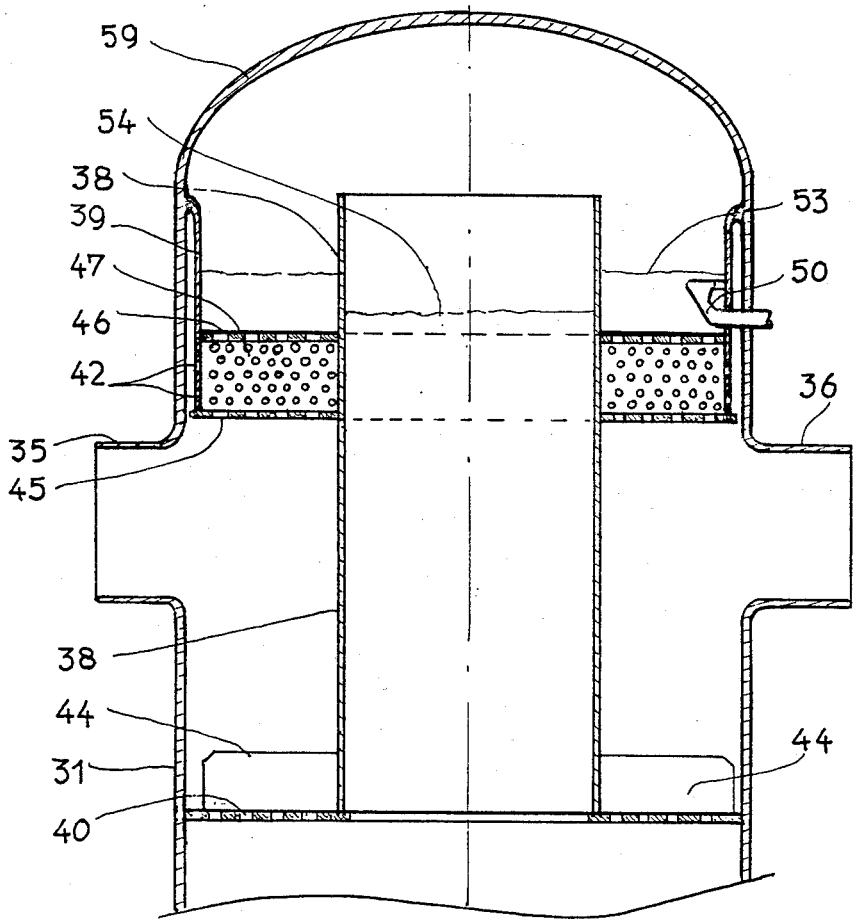
FIG. 2 shows the upper part of a steam generator including the improvements according to the invention in a sectional view through a vertical plane.

FIG. 2 shows the upper part of a steam generator where the lower part situated below the perforated plate 40 comprising the distribution plate of the sodium distributor is identical to the corresponding part of the steam generator shown in FIG. 1 disposed below the distribution plate 10.

The liquid sodium is fed to the inside of the casing 31 by nozzles 35 and 36 emerging into a sodium distribution zone bounded by a central sleeve 38 and by the distribution plate 40. On the distribution plate 40 vertical radial ribs 44 are fastened, occupying almost all of the annular space between the sleeve 38 and the casing 31. The height of these ribs is such that their top is very clearly situated below the sodium entry nozzles.

In order to ensure a homogeneous distribution of the sodium over the whole of the perforated plate 40, eight ribs are arranged on this perforated plate 40 at angles of 45° to each other.

A sleeve 39 with a diameter a little less than that of the casing 31, and disposed coaxially with respect to it, is welded to the casing wall near the upper end 59. This sleeve 39 is perforated with holes 42 allowing the sodium to enter the annular space between the sleeve 39 and the casing 31. This sleeve 39 thus ensures thermal protection of the upper part of the casing 31.

On the sleeve 39 two perforated annular plates 45 and 46 are fastened with a vertical space between them and separated by perforated crosspieces 47.

The holes provided in the annular plates 45 and 46 are substantially identical as far as their dimension and layout are concerned and are identical to those of the plate 40. All these perforations are more or less superposed in a vertical projection.

The annular plates 45 and 46 are arranged between the peripheral sleeve 39 and the central sleeve 38 in the casing zone located immediately above the nozzles 35 and 36.

The assembly comprising the sleeves 38 and 39 and the perforated plates 45, 46 and 40 is fastened to the inside of the casing 31 via the sleeve 39 whose upper part is connected by welding to this casing 31.

During the operation of the steam generator, the upper surface of the liquid sodium in the annular space zone between the casing 31 and the central sleeve 38 is maintained at a level 53 in the annular zone between the sleeves 38 and 39, taking into account the arrival of hot sodium through the nozzles 35 and 36 and the discharge of sodium in the lower part of the steam generator as well as through an overflow 50.

The level of liquid sodium inside the central sleeve 38 which is in direct communication with the lower part of the steam generator, where the nest is located, is at a lower level 54 than the level 53 by virtue of the loss of head between the input and output of the secondary sodium during operation of the steam generator.

The upper end of the sleeve 38 emerges above the level 53 in the argon atmosphere which fills the space between the levels 53 and 54 and the upper end 59. The length of this sleeve is such that its upper end is always above the free level of sodium.

The hot sodium supplied by the nozzles 35 and 36 enters the distribution zone and is then distributed in a homogeneous manner over the nest of tubes by plate 40 and its vertical ribs 44.

The ribs 44 also make it possible to stiffen the plate 40 which is subject to dynamic stresses due to the impulse of the jet entering via the nozzles 35 and 36.

The perforated plates 45 and 46 make it possible to isolate the upper level of the sodium 53, which remains almost stagnant in the annular zone, from the entry of sodium, and thus to eliminate turbulence in this sodium level.

If a leak occurs in the nest of tubes and a pressure wave propagates into the sodium, this pressure wave may propagate as far as the upper level of the liquid sodium both to the interior of the central chimney 38 and to the annular zone located outside this central chimney, owing to the perforated plates 45 and 46 whose perforations are aligned in the vertical direction with the perforations of the lower plate 40.

This pressure wave is not sent back to the intermediate exchangers since no horizontal deflecting plate is present at the interior of the sodium entry and distribution zone as in the generator of the prior art.

Finally, during thermal shocks due to the sodium/-water reaction when a leak occurs in a tube of the nest or in the event of an abrupt variation in generator load, thermal insulation of the upper part of the casing 31 is assured by the stagnant sodium and the argon which is present between the peripheral sleeve 39 and the casing 31.

Thus the principal advantages of the invention are to ensure good distribution of sodium in the nest, to avoid the appearance of turbulence on the upper surface of the sodium in the steam generator, to provide good thermal protection for the upper part of the steam generator, to leave a maximum section open for the propagation of the shock wave resulting from a water leak in the nest towards the free surface and, in particular, to avoid thereby the shock wave being sent back to the intermediate exchangers.

These advantages are obtained in spite of the great simplicity of the structure of the upper part of the steam generator and therefore a reduced cost of construction.

The liquid sodium may be fed to the casing of the steam generator by a number of nozzles other than two, and it is possible to arrange on the lower distribution plate 40 a number of ribs other than eight.

Finally, the invention applies not only in the case of steam generators whose heat-transfer fluid is liquid sodium, associated with a fast breeder nuclear reactor, but also in the case of any steam generator whose heat-transfer fluid is a liquid metal whose reaction with the feed water in the event of a leak in the nest of tubes of the steam generator is liable to create pressure waves.

I claim:

1. A device for producing steam by heat exchange between a heat-transfer liquid metal and feed water, comprising an elongate cylindrical casing (31) disposed with its axis vertical, closed top and bottom by an upper end (59) and a lower end respectively, said casing receiving liquid metal in its upper part through at least one nozzle (35, 36) traversing said casing (31) and emerging in a space bounded by a central sleeve (38) coaxial with said casing and extending a certain distance above and below said at least one liquid metal entry nozzle (35, 36) and by a lower perforated annular plate (40) situated between said casing (31) and said central sleeve (38) and at the lower part of said sleeve, in such manner that an upper level of liquid metal (53, 54) is maintained above said at least one nozzle (35, 36), inert gas filling a space existing between said level of liquid metal (53, 54) and said upper end (59) of said casing (31) and that circulation of liquid metal is established in said casing (31), in contact with a bundle of tubes in which circulates the feed water which is being vaporized, said bundle of tubes being situated below the space where said liquid metal enters, said liquid metal leaving said casing (31) at its lower part, a peripheral sleeve (39) within the upper part of said casing (31) being fastened on said casing (31) and arranged coaxially at a short distance therefrom above said liquid metal entry nozzle (35, 36), two annular perforated plates (45, 46) being fastened between said central sleeve (38) and said peripheral sleeve (39) above said liquid metal entry nozzle (35, 36), spaced according to the height of said casing (31) and separated by vertical perforated crosspieces (47), the perforations in said annular plates (45, 46) and said lower plate (40) being of substantially equal diameter and disposed in each of said plates (45, 46, 40) so as to be in vertical alignment with corresponding perforations in the others of said plates.

2. Device for producing steam according to claim 1, wherein the upper end of said central sleeve (38) is above the free level of said liquid metal and below said upper end (59).

3. Device for producing steam according to claim 1 or 2, comprising radial stiffening ribs (44) fixed on said lower plate (40), said ribs having a height less than the vertical distance between said lower plate (40) and said liquid metal entry nozzle (35, 36).

* * * * *